United States Patent [19]

Maxwell

[11] 4,371,070

[45] Feb. 1, 1983

[54] KEY DEPOSIT RETURN MACHINE

[76] Inventor: Harry L. Maxwell, Rte. 5, Box 269-A, Cookeville, Tenn. 38501

[21] Appl. No.: 228,545

[22] Filed: Jan. 26, 1981

[51] Int. Cl.[3] ..... G07F 7/02

[52] U.S. Cl. ..... 194/4 D; 221/66

[58] Field of Search ..... 194/4 D, 51, 59, 65, 194/4 R, 4 E, 4 F, 4 C; 221/66

[56] References Cited

U.S. PATENT DOCUMENTS 2,997,151 8/1961 Chandler ..... 194/51

3,165,691 1/1965 McClanahan ..... 194/4 R

*Primary Examiner*—Stanley H. Tollberg

*Attorney, Agent, or Firm*—Shlesinger, Arkwright, Garvey & Dinsmore

[57] ABSTRACT

A deposit for a key is returned after the key is deposited in the machine where an element on the key unlocks the coin control mechanism.

9 Claims, 6 Drawing Figures

FIGURE 1
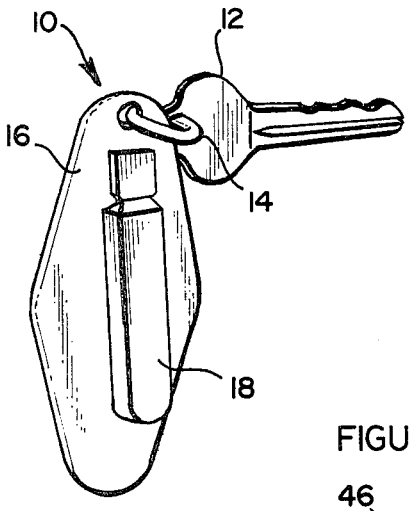
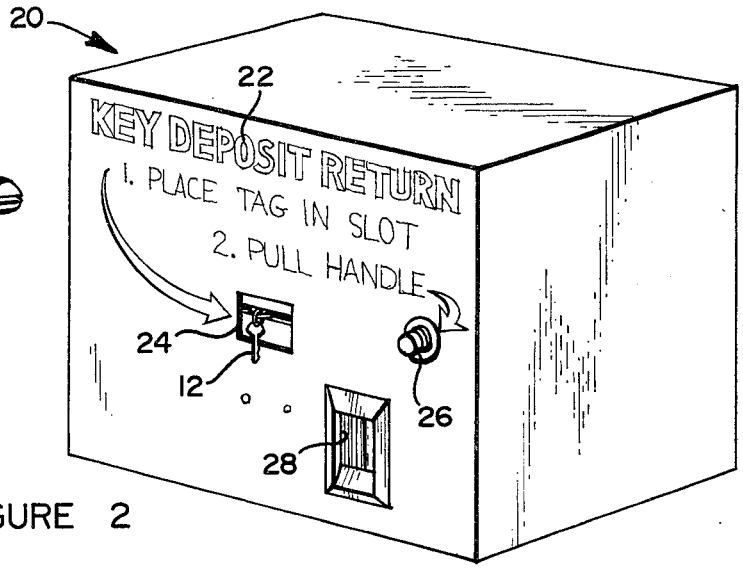
FIGURE 2
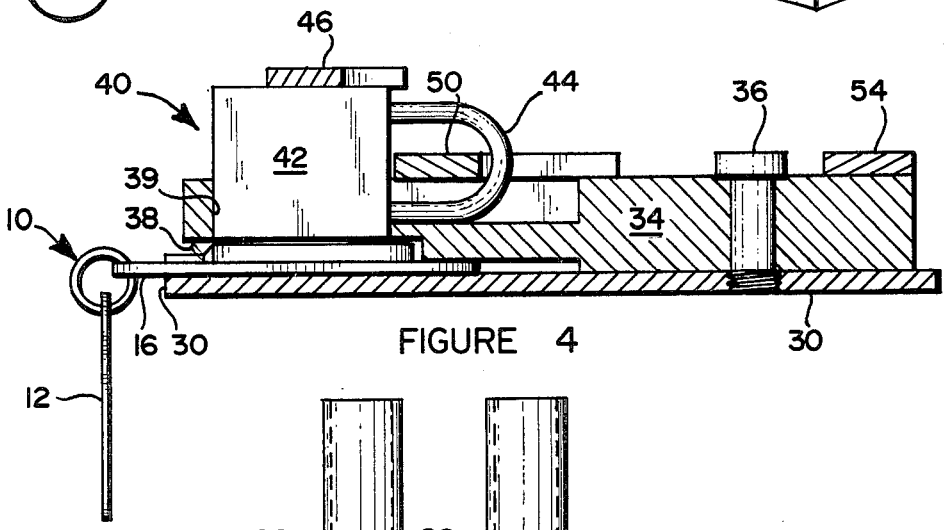
FIGURE 4
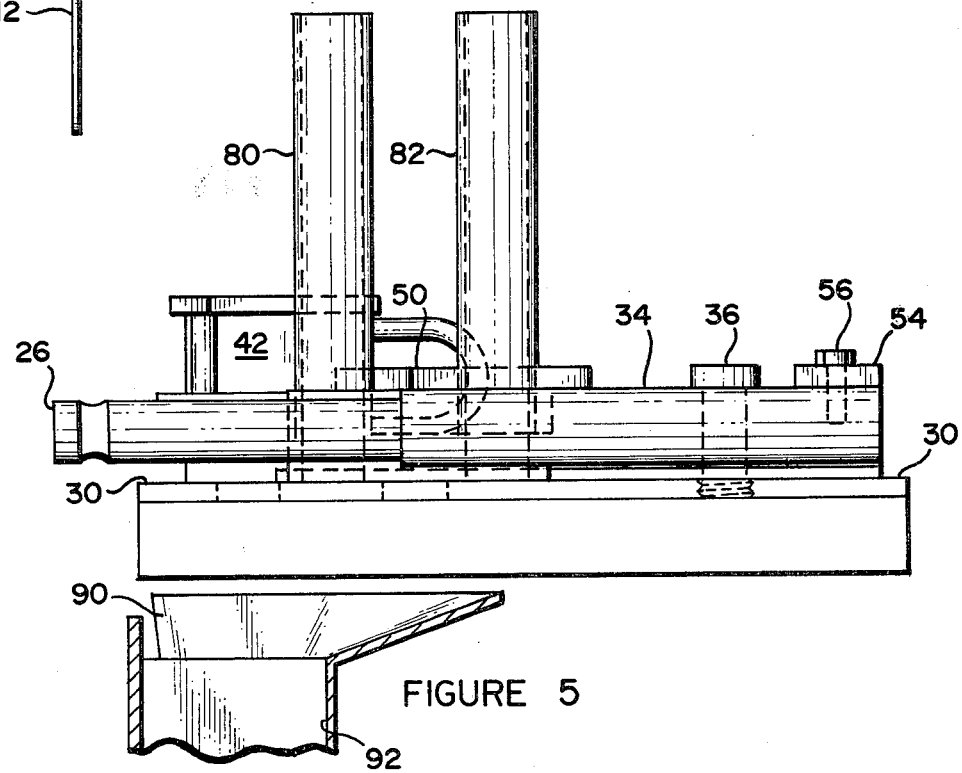
FIGURE 5

KEY DEPOSIT RETURN MACHINE

BACKGROUND OF INVENTION

This invention relates to a deposit return machine, and particularly to a machine for returning a deposit where keys which are lent to users for a specified purpose, are to be subsequently returned to the owner.

In many cases, such as in the hotel and motel trade, it is necessary to give a key to a guest who subsequently is to return it to the hotel. In many instances, such keys are taken with the user and not returned to the establishment. This has been a persistent problem. One system used to get a higher rate of key return has been to require a key deposit which is returned to the user on return of the key.

One of the problems that arises with this practice is that, in many instances, it is inconvenient to return the deposit. In a motel or hotel such transaction must take place at the cashier's desk. This has a drawback in that it imposes another operation on the cashier and delays those waiting to pay their bills.

Consequently, in many instances, it is not worthwhile to a motel to require a deposit for a key, and the loss rate is higher due to nonreturn of keys. Further, the keys must be returned to the desk, making it inconvenient for the guest and further contributing to greater loss of keys.

SUMMARY AND FEATURES OF INVENTION

Accordingly, it is a principal feature of this invention to provide an acceptable method of encouraging key users to return keys.

It is a further feature of this invention to provide a machine which will accept the key and simultaneously dispense the key deposit.

A still further feature of this invention is to provide a device which will make it possible for deposits on keys to be returned to motel guests at any time, without involving the front desk.

A still further feature of this invention is to provide a device which makes it possible to completely free the cashier from the key return procedure and deposit payment.

A still further feature of this invention is to provide a convenient receptacle for keys which can be placed at a convenient location and automatically returns a deposit.

Another feature of this invention is a simple combination of coin dispensing assembly with simultaneous key-receiving device.

A still further feature of this invention is the use of the key structure itself to provide the unlocking control for the key return machine.

These and further features of this invention will become apparent from the following description of the drawings.

DESCRIPTION OF THE DRAWINGS

FIG. 1 discloses a typical key adapted for use with this invention.

FIG. 2 is a perspective view of the machine itself.

FIG. 4 is a sectional view of FIG. 3 along a line coinciding with the magnetic lock surface.

FIG. 5 is an end view of the mechanism of FIG. 3.

DESCRIPTION OF THE INVENTION

Figure 3:
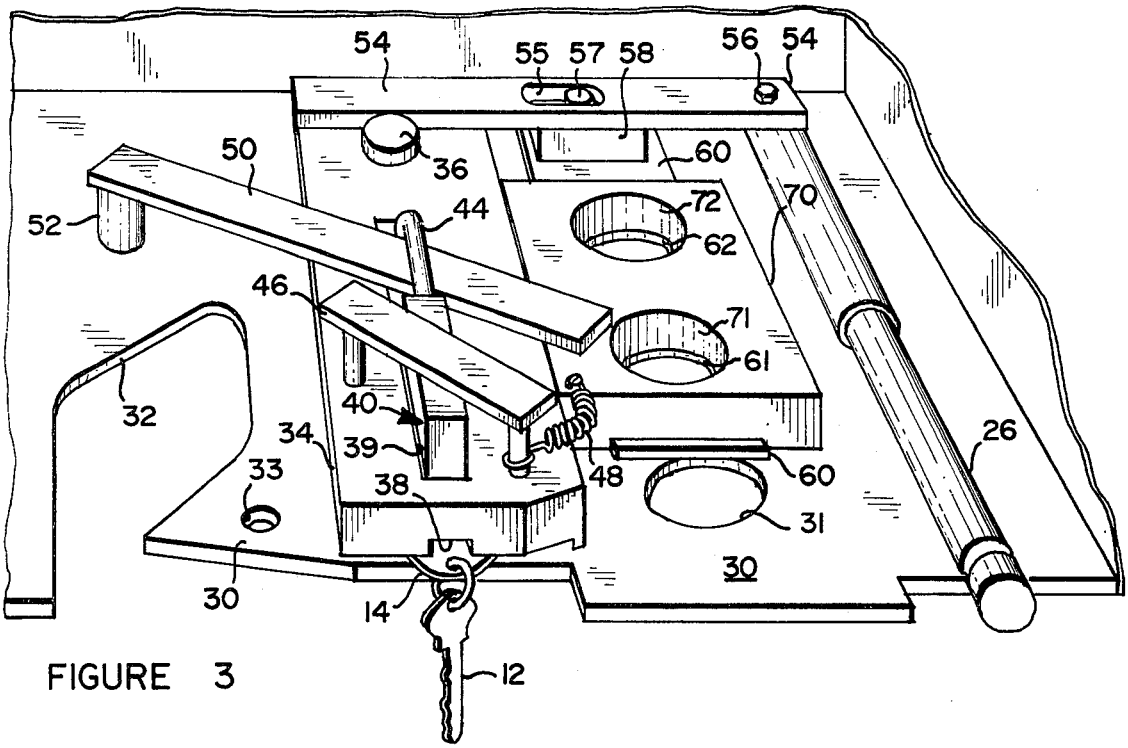
FIG. 3 is a perspective view of the internal mechanism of the key return deposit machine when the key is inserted into the machine.

Referring to the drawings, FIG. 1 discloses a key assembly generally indicated at 10, having a key 12 with a ring 14 to which a tag 16 is attached. An activating element 18 is attached to the tag 16.

FIG. 2 is a perspective view of the machine housing which can be either mounted on the wall or mounted on a table at a convenient location. It has a front face 22 with an opening 24 through which the key assembly 10 is inserted. A pull-handle 26 is grasped by the person depositing the key to actuate the mechanism and provide for a return of the deposit through the deposit return slot opening 28. The element 18 on the key tag 16 is a magnet. When this comes into position within key receiving opening 24, a commercially available lock within the housing, the lock opens. The shackle of the lock is spring-biased to a locking position.

A perspective view of the actuating mechanism of the device is shown in FIG. 3 when it is in the key-receiving position prior to the pulling of handle 26. A sectional view along line 4—4 of FIG. 3 shows the lock and the key tag in position, before pulling of handle 26 and outward pull on the shackle 44 of the magnetic lock. The base plate 30 supports the entire actuating assembly and is a flat plate extending horizontally across the midsection of the receptacle 20. It has two spaced coin return openings 31 and a key tag deposit opening 32. The small opening 33 receives a safety latching mechanism.

The plate 30 supports a thick bar-like magnetic lock holder 34 which is pivotally mounted on base plate 30 by the pivot screw 36. The pivot screw is fastened into the base plate 30 as shown in FIG. 4. The underface of the magnetic lock holder member 34 has a grooved configuration 38 for receiving both the tag and its activating element 18. It has a lock receiving groove 39 within which the magnetic lock 40 is fixedly mounted. The magnetic lock is commercially available.

As can be seen in FIG. 4, the body of the lock 42 is recessed and held in position on the plate 30 in an upright position. The slot 39 is elongated at its upper end to permit the shackle 44 of the lock to move outwardly. The holding assembly 46 holds the lock in an immovable position. The element 18 on the key tag 16 is a magnet. When this comes into position in the slot, the lock opens. The shackle 44 is spring-biased to a locking position.

A return spring 48 is attached to the lock retaining assembly for applying a continual force which will hold the magnetic lock holder in key receiving position.

A fixed bar cam 50 is held in a rigid angular position by end mounting post 52. The bar extends through the lock shackle 44 and acts to exert force against it to prevent any pivotal movement of the magnetic lock holder until the lock is actuated by the insertion of the activating element on the key assembly.

The coin slide link 54 is rigidly connected to the magnetic lock holder 34 immediately behind the pivoted locking screw 36. It has an elongated slot 55 and a pivot screw 56. The latter is attached to the actuating handle 26.

An upstanding lug 57 of the coin slide spacer 58 rides within the elongated slot 55. The coin slide spacer 58 is connected to the coin slide spacer and feeder plate 60.

The feeder plate has two openings 61 and 62 which are positioned to align with the coin openings 31 of the base plate 30 to permit coins to drop through the base plate 30.

The coin slide plate 60 is fitted and reciprocates within a grooved underside of the coin tube holder block 70. The block 70 has annular openings 71 and 72 which support vertically mounted coin holding cylinders 80 and 82 (shown in FIG. 5).

When the coins are moved by the coin slide plate 60 into alignment with the openings 31 in the base plate 30, the two coins moved with the slider plate 60 from the bottom of the stack of coins by the periphery of openings 61 and 62 drop to the coin return box 90 where they fall down into the opening 28.

The assembly shown in FIG. 5 shows the interrelationship of the pull handle, the actuating piece 54, and the position of the coin retaining or holding cylinders 80 and 82, and the coin chute 90.

OPERATION

To operate the machine, the user inserts the key assembly 10, tag first with the actuating element 18 upright into the openings 24 of the machine as shown in FIG. 2, and pulls the handle 26. The key will be withdrawn from the opening 24 and simultaneously coins will fall down into the coin return chute opening 28.

Figure 6:
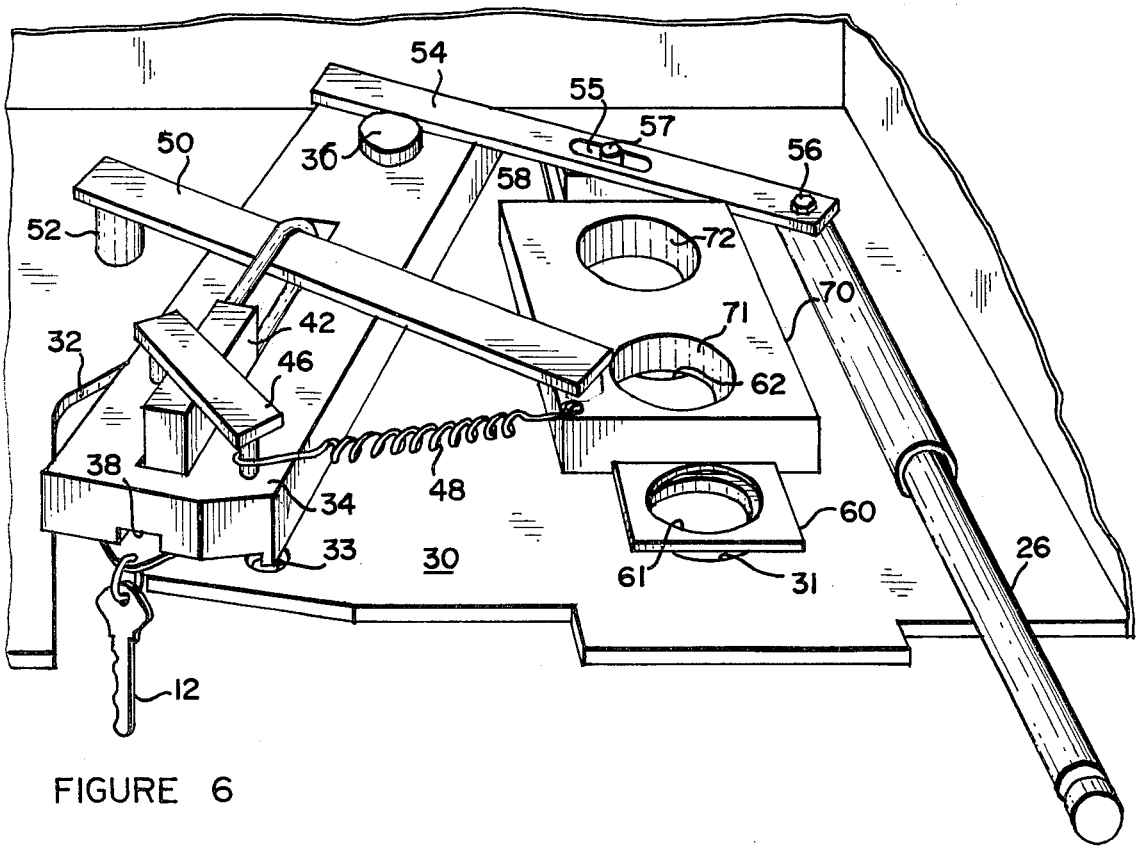
FIG. 6 is a perspective view of the internal actuating mechanism of the machine after the mechanism is actuated.

The actuating mechanism is shown in FIG. 3 in the initial position, and in FIG. 6 in the position after the handle 26 has been pulled.

Referring to FIGS. 3 and 6, it will be seen that when the pull handle 26 is pulled toward the user, the coin slide link 54, which is rigidly connected to the magnetic lock holder block 34, acts to pivot the magnetic lock holder block 34 about the pivot screw 36. This moves the forward end of the block adjacent the key receiving slot 38 laterally to a position directly over the key-receiving opening 32 and the key drops into the lower portion of the machine receptacle.

When the key is inserted within the key-receiving opening 24, with the element 18 disposed within the slot 38 of FIG. 3, the magnetic lock is opened. It is then possible for the magnetic lock holder block 34 to move laterally along the cam bar 50. This will permit the handle to be pulled outward toward the user.

Simultaneously with the movement of the magnetic lock holder block 34, the coin slide spacer 58 is moved by the coin slide link 54 in a forward direction toward the front face of the machine. This moves the coin slide plate 60 forward bringing two coins from the bottom of the stacked columns into alignment.

When the coin slide spacer moves forward, it is moved into alignment with the openings 31 in the base plate 30 so that the coins drop through this plate and into the coin return chute which terminates at the opening 28 at the front face of the machine housing 20.

After the coin return is made, the spring 48 will return the magnetic lock holder block to its initial position of FIG. 3 and simultaneously retract the handle 26 to its initial position.

While this invention has been described, it will be understood that it is capable of further modification, uses and/or adaptations of the invention following in general the principle of the invention and including such departures from the present disclosure as come within known or customary practice in the art to which the invention pertains, and as may be applied to the essential features hereinbefore set forth, as fall within the scope of the invention or the limits of the appended claims.

What I claim is:

1. A key and tag assembly deposit return machine, comprising:

(a) a housing having a key and tag receiving opening, and a coin return opening, (b) key and tag receiving means disposed within the housing and associated with the key receiving opening for receiving the key and tag within the opening and moving it into the housing, (c) a coin return means disposed within the housing in communication with the coin return opening and associated with the key and tag receiving means for dispensing coins when a key and tag has been received by the key and tag receiving means.

2. The key and tag assembly deposit return machine as set forth in claim 1, wherein:

(a) the key and tag receiving means includes an unlocking means responsive to an element disposed on the key and tag assembly for permitting operation of the coin return means.

3. The key and tag assembly deposit return machine as set forth in claim 2, wherein:

(a) the element has magnetic properties, and (b) the unlocking means includes a magnetic lock which is responsive to the element.

4. The key and tag assembly deposit return machine as set forth in claims 1 or 3, wherein:

(a) the coin return means includes a store of coins to be dispensed totaling a predetermined amount for each key and tag returned.

5. The key and tag assembly deposit return machine as set forth in claim 1, wherein:

(a) the coin return means has a manually operable actuating element.

6. The key and tag assembly deposit return machine as set forth in claim 1, wherein:

(a) the key and tag receiving means includes a movable element which receives the key and tag assembly and moves it to a position within the housing, and (b) linkage means is connected to the movable element for providing manual operation of the movable element.

7. The key and tag assembly deposit return machine as set forth in claim 6, wherein:

(a) the manually operable linkage is also connected to the coin return means.

8. The key and tag assembly deposit return machine as set forth in claim 1, wherein:

(a) the coin return means includes a store of vertically disposed coins disposed above a horizontally slidable plate having circular openings matching the size of the coins to be dispensed.

9. The key and tag assembly deposit return machine as set forth in claim 8, wherein:

(a) the coin slide plate is connected to a link which forms part of the key and tag receiving means, the link forming a common actuating member for both the coin slide plate and the key and tag receiving means.

* * * * *